United States Patent [19]

Spieldiener et al.

[11] 4,033,602

[45] July 5, 1977

[54] SKI BRAKE

[75] Inventors: Robert Spieldiener; Reinhold Spieldiener, both of Zurich; Alphons Saiko, Oberrieden, all of Switzerland

[73] Assignee: Intamin AG, Zurich, Switzerland

[22] Filed: May 24, 1976

[21] Appl. No.: 689,346

[30] Foreign Application Priority Data

May 22, 1975 Austria ..... 3879/75

[52] U.S. Cl. ..... 280/605

[51] Int. Cl.[2] ..... A63C 7/10

[58] Field of Search ..... 280/605, 604

[56] References Cited

UNITED STATES PATENTS

| | | | |
|---|---|---|---|
| 3,083,028 | 3/1963 | Miller | 280/605 |
| 3,930,659 | 1/1976 | Salomon | 280/605 |
| 3,940,158 | 2/1976 | Wehrli | 280/605 |

FOREIGN PATENTS OR APPLICATIONS

| | | | |
|---|---|---|---|
| 2,429,639 | 3/1975 | Germany | 280/605 |

*Primary Examiner*—Joseph F. Peters, Jr.
*Assistant Examiner*—David M. Mitchell
*Attorney, Agent, or Firm*—Ernest G. Montague; Karl F. Ross; Herbert Dubno

[57] ABSTRACT

A ski brake preventing free flight of the ski upon its inadvertent release from the ski boot comprises a U-shaped stirrup whose shanks straddle the longitudinal edges of the ski and are provided with braking elements and a pair of torsion rods connected to the shanks and received in a mounting retaining the surface of the stirrup on the ski. When the bight of the U-shaped member is held against the ski by the ski boot directly or a plate of the ski binding, the brake elements are swung upwardly to the upper surface of the ski and lie parallel to the longitudinal edges. When the stirrup is released the resilient action of the torsion rods rotates the stirrup into a position in which the brake elements project symmetrically transverse to the longitudinal edges and below the bottom surface of the ski to prevent free flight.

5 Claims, 7 Drawing Figures

Fig. 1
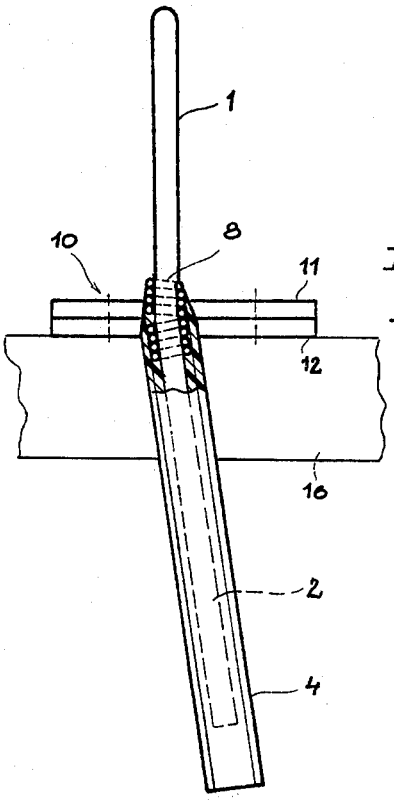
Fig. 2
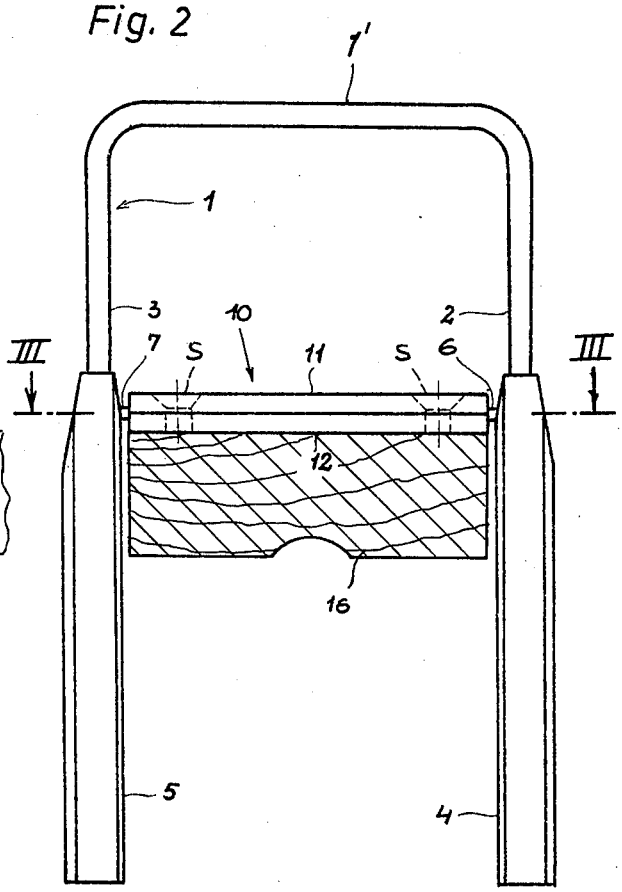
Fig.3A
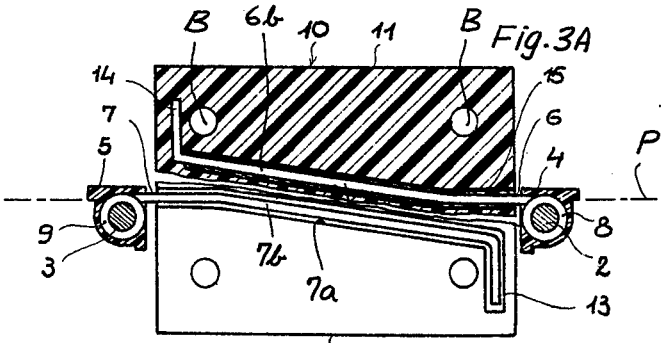
Fig.3B
Fig.5
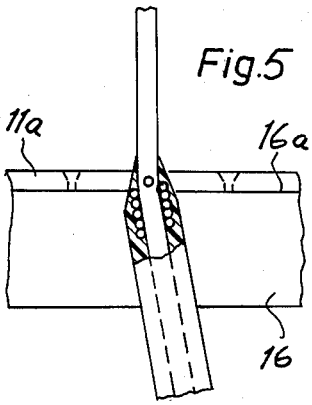

16
17
18
11'

14
7
6
3
2
13

12'
21
20
19

SKI BRAKE

FIELD OF THE INVENTION

The present invention relates to a ski brake adapted to prevent free flight of the ski upon inadvertent release of the ski boot or binding therefrom.

BACKGROUND OF THE INVENTION

The dangers of free flight of a ski, which can carom downhill out of the control of the skier upon inadvertent release of the ski from the ski boot or binding has long concerned the art. It has been proposed to avoid such free flight by attaching a safety strap between the leg of the skier and the ski. Devices of this type are restrictive and frequently are not sufficiently reliable to completely solve the problem. Furthermore, a tether of this type requires additional manipulation in mounting the ski on the ski boot and may be avoided by the skier.

To overcome these problems and prevent injury to those persons on the slope, it has been proposed to provide the ski with a so-called ski brake designed to present a brake element or member to the snow and thereby restrict free flight of the ski, the brake element being placed in its operative position automatically upon release of the ski boot or binding from the upper surface of the ski.

For example, one such ski brake has a shank rotatable about an axis perpendicular to the longitudinal axis of the ski by a spring force, thereby rotating the brake element into its operative position upon opening or release of the ski binding. The brake element or spike thereupon swings into a position in which it projects beyond the running surface of the ski. While this system has been found to be effective, especially when the shank extends across the ski and is provided with such spikes along either longitudinal edge to increase the effectiveness of braking, it has been found that the device tends to ice up and jam so that it is of dubious reliability.

In general, when the brake device has been provided with rotating axles, helical or spiral springs, bearings to effect rotation and like elements, blocking or jamming of the device with snow or ice has been a problem. The problem has been found to remain even when the spring assembly and bearings are received in a housing structure.

Another disadvantage of conventional structures is the height or thickness of the housing assembly when numerous parts are provided to generate the spring action and the rotation. Since the ski brake actuator should preferably be provided between the ski boot or binding mounting plate and the upper surface of the ski, any excessive height of such housings and mechanisms, any unduly large spring arrangement or bearing mechanism interferes with satisfactory positioning of the device.

It has been proposed to provide a relatively flat mounting for a ski brake in which, for example, a spring wire loop has a pair of legs received in a mounting plate and carries a spike or brake element which lies along one side of the ski. This system, while free from some of the disadvantages enumerated above acts asymmetrically and hence unreliably. The assembly is also difficult and expensive to construct and cannot always be actuated or inactivated effectively.

Objects of the Invention

It is the principal object of the present invention to provide an improved ski brake of simplified construction, high reliability and freedom from the disadvantages of the earlier systems described above.

Another object of this invention is to provide an improved ski brake for the purposes described which is composed of a relatively small number of parts, has a small height for its mounting structure, minimizes the possibility of snow or ice accumulation in pivotal portions or the like and is inexpensive.

Still another object of this invention is to provide an improved ski brake of greater versatility than earlier brakes, offering the possibility of use with any type of ski binding, including so-called plate bindings.

SUMMARY OF THE INVENTION

These objects and others which will become apparent hereinafter are attained, in accordance with the present invention, by providing a ski brake having a U-shaped stirrup member whose shanks straddle the opposite longitudinal edges of the ski and which is rotatably supported on the upper surface of the ski exclusively by torsion rods. Thus, an important feature of the invention is that the pivotal axis of the stirrup is exclusively formed by torsion rods which are connected to the shanks of the stirrup preferably by coil-like turns surrounding the shank. According to another important feature of the invention, the torsion rods are held on the ski surface at least in part in a mounting plate such that the height of the ski brake can be minimized, the support having a minimum height sufficient only to retain the torsion rods. Since the height depends exclusively on the thickness of the mounting plate, heights of about 5 mm can be used. Since no special bearings, such as axles and journals are required, the construction is greatly simplified by comparison with earlier devices and far more reliable.

To hold the torsion rods, we prefer to provide a two-part mounting plate with the torsion rod being clamped between the plates thereof.

Of course, the free ends of the torsion rods can be held on the mounting plate by welding during the fabrication of the assembly.

According to an important feature of the invention, the plate-engaging ends of the torsion rods are bent at an angle to the remainder thereof, thereby increasing the resistance to rotation of the rods in the plate. The straight portion of each rod thus forms a torsion spring which is received in a passage or recess of the mounting plate and can be freely rotatable while the bent end of each rod is held against rotation in the mounting plate.

According to another feature of the invention, the torsion rods in the region of the mounting plate are received in friction-reducing or friction-eliminating sleeves, e.g. of polytetrafluoroethylene, thereby insuring free rotation of the relatively straight portions.

To accommodate the ski brake to skis of different width which should be straddled by the shanks and brake elements, the bent ends of the torsion rods can be receivable in sockets spaced apart across the width of the ski and formed in at least one of the mounting plates.

The torsion rods from the opposite shanks, in order to prevent interference with one another may have their bent ends turned in opposite directions and may themselves be angled away from a plane of the stirrup perpendicular to the ski surfaces and the longitudinal axis thereof.

BRIEF DESCRIPTION OF THE DRAWING

The above and other objects, features and advantages of the present invention will become more readily apparent from the following description, reference being made to the accompanying drawing in which:

FIG. 1 is a side-elevational view, partly broken away, showing the brake in its operative position;

FIG. 2 is a front-elevational view of the brake assembly showing the ski in cross-section;

FIGS. 3A and 3B are respectively views taken along the line III—III of FIG. 2 for a single-piece molded mounting plate and a two-piece mounting plate;

FIG. 5 is a detail view of the connection of the torsion rod to the shank of the stirrup according to another feature of the invention.

SPECIFIC DESCRIPTION

Figures 4A, 4B:
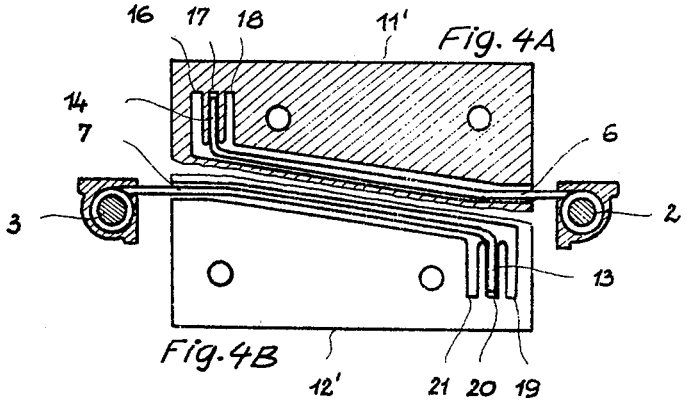
FIGS. 4A and 4B are views similar to FIGS. 3A and 3B, respectively, showing another embodiment of the invention with means for adjusting the device for skis of different width.

As can be seen from FIGS. 1, 2 and 3B, the ski brake comprises a substantially U-shaped stirrup 1 with two shanks 2 and 3 which are embedded in sheaths 4 and 5 of synthetic-resin material, the sheaths 4 and 5 forming braking elements or spikes engageable with the snow. Each of the shanks 2 and 3 is provided approximately centrally with a transversely-extending torsion rod 6, 7. Screw-like turns 8, 9 at one end of each torsion rod is snugly fitted around the respective shank 2 or 3 to secure the torsion rods to the shanks. A mounting plate 10 secures the stirrup to the upper surface of a ski 16.

According to FIGS. 1 and 2 and FIG. 3B, the mounting plate comprises two parts or plates 11 and 12 between which the torsion rods are received and held. The gripping of each torsion rod is effected at its bent free end 13 or 14 which is anchored immovably between the plates 11 and 12. The remainder of the torsion rod 7 passes with clearance through a passage 7*a* formed by juxtaposed recesses in the confronting faces of the plates 11 and 12 so that the torsion rod is freely rotatable except for its end 13 and 14.

As illustrated also in FIGS. 3A and 3B, the stirrup 1 lies generally in a plane P from which the straight portions 6*b* or 7*b* of the torsion rod are angled so as not to interfere with one another.

In the embodiment of FIG. 3A, the mounting plate 10 is shown to be formed in a single piece with the torsion rod end 14 cast therein. For friction-free twisting action, the torsion rod can be received in a sleeve 15.

It is also possible, as has been illustrated in FIG. 5, to use only a single plate 11*a* to clamp the torsion rods between the upper surface 16*a* of the ski 16 and this plate 11'. The mounting plates are traversed by screws S passing through bores B which enable the assembly to be applied to any ski.

In FIGS. 4A and 4B the single mounting plate (FIG. 4A) or the bipartite mounting plate (FIG. 4B), represented at 11', 12', for receiving the bent ends 13, 14 of the torsion springs are provided with spaced-apart sockets 16, 17 and 18 or 19, 20, 21 across the width of the ski. The sockets 16 and 19 correspond to the passages in which the bent ends of the torsion springs of FIGS. 3A and 3B are received. If the ski brake is to be provided on a wider ski blade, the ends 13 and 14 are fitted into the sokcet 17 and 20. Conversely, when a still wider ski is used, sockets 18 and 21 are employed. When the bent ends 13 and 14 are inserted in the appropriate sockets, the two plates can be closed on one another and applied to the ski with screws. Of course, the sockets may be formed in only one of the plates, whereupon the other plate serves merely as a cover plate or, as in the case of FIG. 4A, in a single plate which is then held against the ski to close the socket from below.

When the ski boot or the plate of a plate binding presses normally down against the bight 1' of the stirrup 1, the stirrup is held against the upper surface of the ski and is rotated so that the torsion rods 6 and 7 are twisted and apply a restoring force to the stirrup. The spikes 4 and 5 lie along the longitudinal edges of the ski to permit normal skiing. Upon release of the boot or the binding plate, the stirrup 1 springs into the position shown in FIGS. 1 and 2 and the ski is braked symmetrically against free flight. Such automatic operation of the ski occurs with any fall or other accident resulting in opening of the ski binding.

We claim:

1. A ski brake for a ski comprising:

a stirrup adapted to straddle the ski and having a bight extending across the width of the ski and a pair of shanks displaceable from an inoperative position wherein said bight is held against the surface of said ski and said shanks extend generally along the longitudinal edges thereof, into an operative position wherein said shanks extend transversely to said ski;

respective brake elements on said shanks and extending therealong engageable with the snow in said operative position of said stirrup to brake free flight of the ski;

a pair of torsion rods each secured at one end to a respective one of said shanks with a coil surrounding same; and mounting means comprising at least one plate receiving said torsion rods and retaining the other end of each of said torsion rods against rotation, said torsion rods forming the sole pivots enabling displacement of said stirrup from said inoperative position to said operative position.

2. The ski brake defined in claim 1 wherein said mounting means comprises a pair of mounting plates clamping said torsion rods between them.

3. The ski brake defined in claim 1 wherein each of said other ends is bent angularly from the remainder of the respective torsion rod.

4. The ski brake defined in claim 1 wherein each of said torsion rods is at least partially received in an antifriction sleeve interposed between the torsion rod and said plate.

5. The ski brake defined in claim 1 wherein said mounting means is provided with a plurality of sockets spaced across the ski for selectively receiving said other ends of torsion rods, thereby enabling adjustment of the spacing between said shanks to correspond to the width of the ski.

* * * * *